US008272976B2

(12) United States Patent
DAgostino

(10) Patent No.: US 8,272,976 B2
(45) Date of Patent: Sep. 25, 2012

(54) GOLF CLUB WITH PICK AND PLACE FEATURE

(76) Inventor: Robert DAgostino, South Attleboro, MA (US)

( * ) Notice: Subject to any disclaimer, the term of this patent is extended or adjusted under 35 U.S.C. 154(b) by 134 days.

(21) Appl. No.: 12/806,503

(22) Filed: Aug. 13, 2010

(65) Prior Publication Data

US 2011/0053700 A1 Mar. 3, 2011

Related U.S. Application Data

(60) Provisional application No. 61/237,512, filed on Aug. 27, 2009.

(51) Int. Cl.
*A63B 53/04* (2006.01)

(52) U.S. Cl. ..... 473/345; 473/346; 473/324; 294/19.2

(58) Field of Classification Search ..... 473/282, 473/284, 285, 324, 340, 345, 346, 350; 294/19.2
See application file for complete search history.

(56) References Cited

U.S. PATENT DOCUMENTS

| | | | | | |
|---|---|---|---|---|---|
| 2,561,815 | A * | 7/1951 | Oberg | 294/19.2 |
| 3,169,790 | A * | 2/1965 | Kaanehe | 294/19.2 |
| 4,493,503 | A * | 1/1985 | Jeninga | 294/19.2 |
| 4,580,784 | A * | 4/1986 | Brill | 473/286 |
| 5,692,968 | A * | 12/1997 | Shine | 473/286 |
| 5,725,441 | A * | 3/1998 | Jensen et al. | 473/251 |
| 6,878,072 | B1 * | 4/2005 | Henry | 473/286 |
| 7,223,178 | B2 * | 5/2007 | Henry | 473/252 |
| 7,559,848 | B2 * | 7/2009 | Nickel | 473/286 |
| 2005/0176520 | A1 * | 8/2005 | Henry | 473/286 |
| 2007/0049395 | A1 * | 3/2007 | Solheim et al. | 473/251 |
| 2009/0137335 | A1 * | 5/2009 | Miller | 473/285 |

* cited by examiner

*Primary Examiner* — Gene Kim
*Assistant Examiner* — John E Simms, Jr.
(74) *Attorney, Agent, or Firm* — Robert J. Doherty

(57) ABSTRACT

A golf club that picks up a golf ball, sets the golf ball on a tee and may be used to hit the golf ball by providing an opening in the golf club head for entrance of the golf ball which through a series of inclining and declining planes and bumpers the ball rolls into the back of the golf club via a push down motion, thence the golf club can be picked up, held above the tee, and with a turn of the wrist the golf ball can be set upon the tee for driving by the same golf club.

5 Claims, 9 Drawing Sheets

FIG. 5
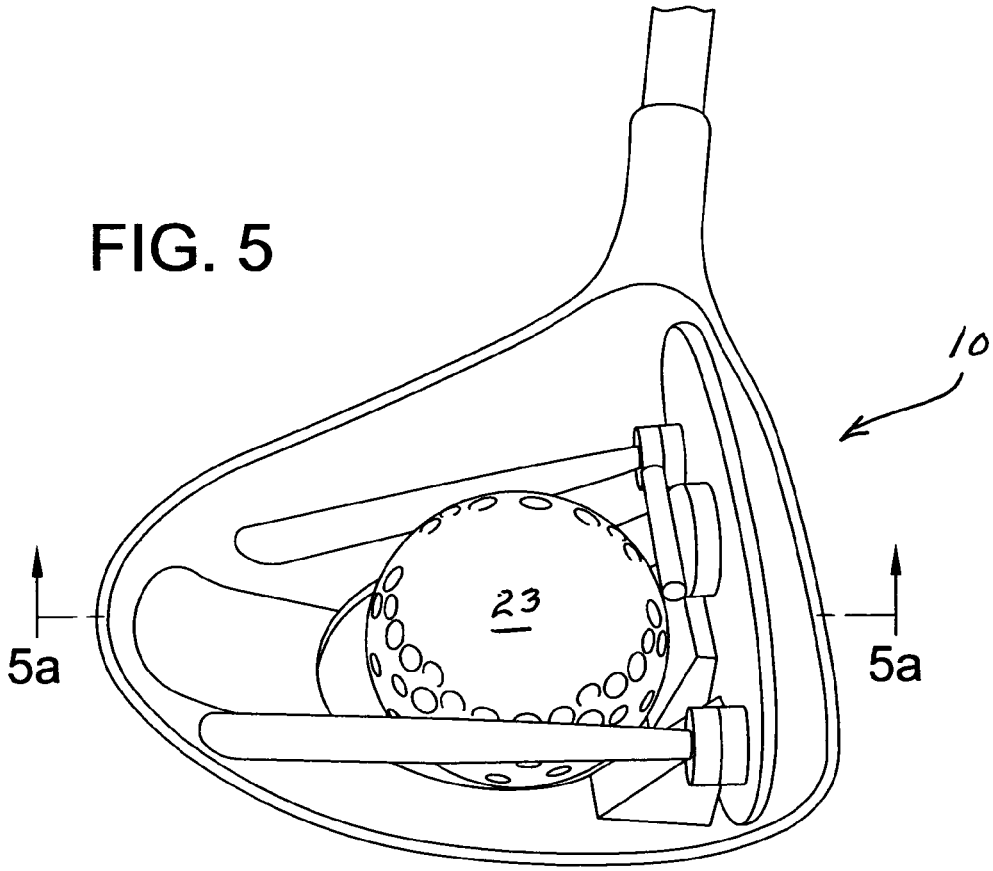
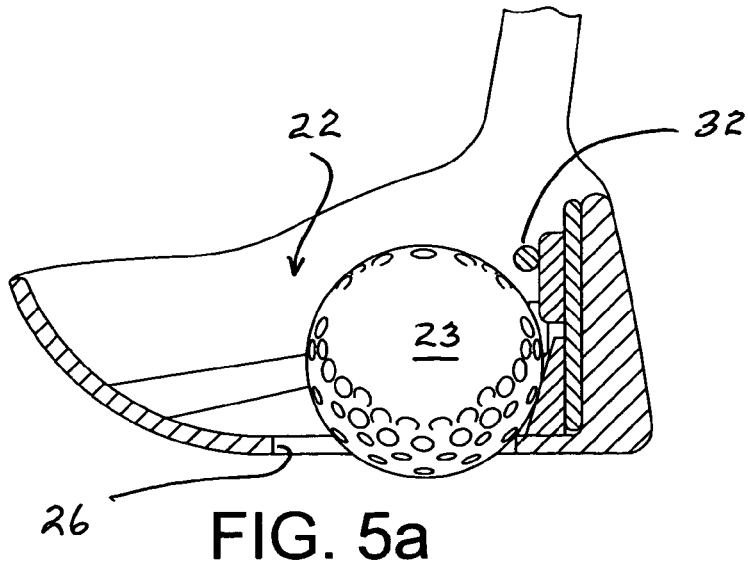
FIG. 5a

FIG. 7
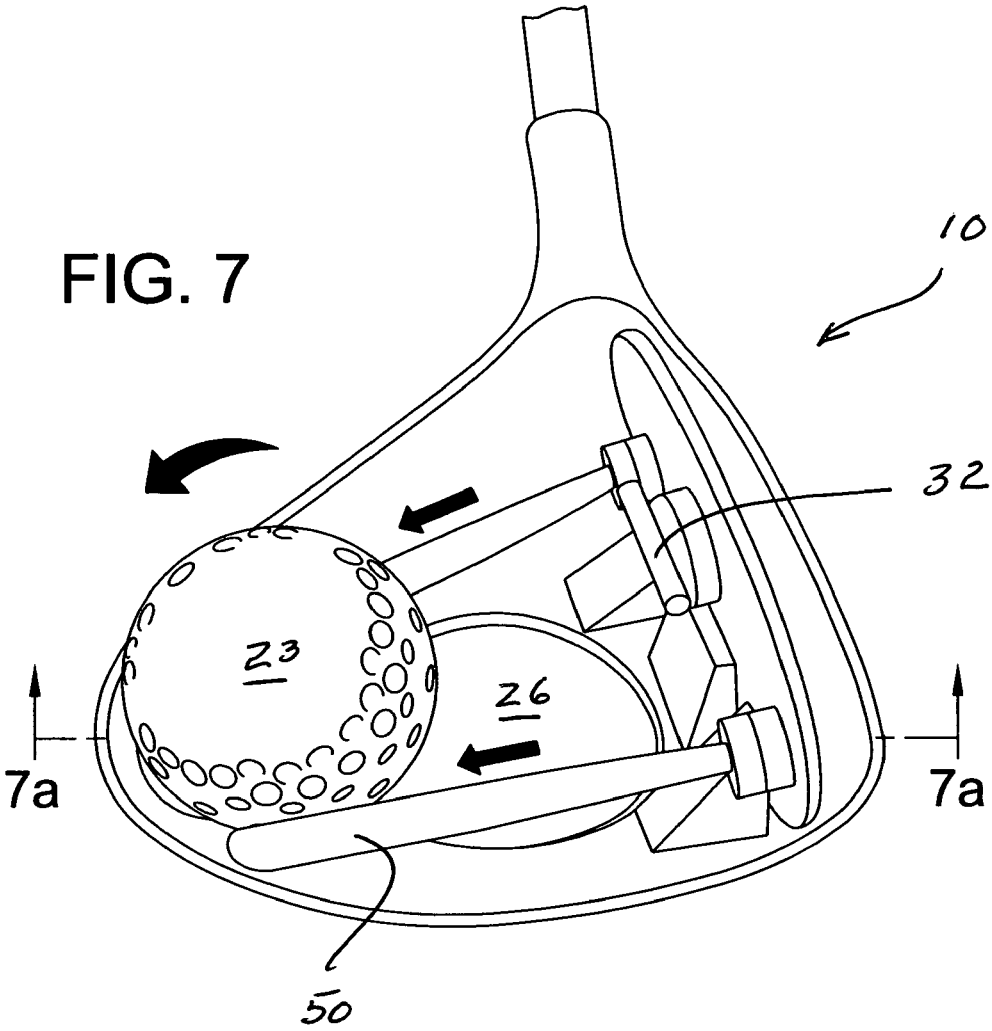
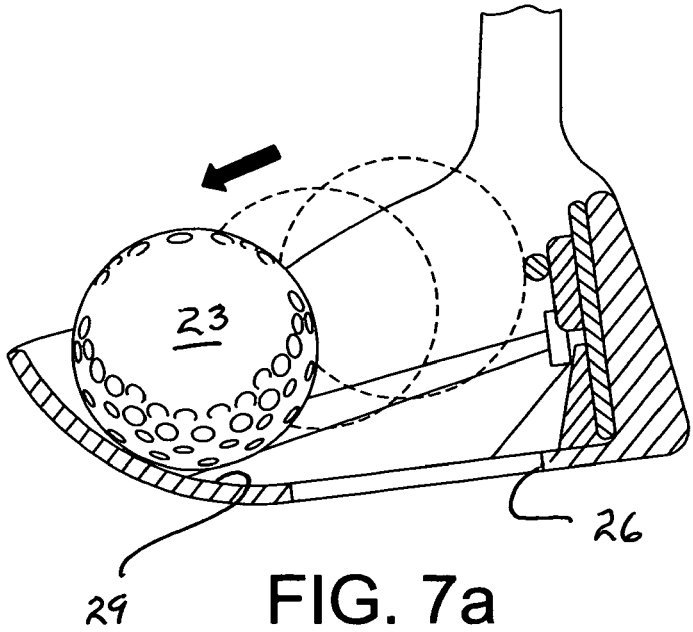
FIG. 7a

GOLF CLUB WITH PICK AND PLACE FEATURE

This application claims the benefit of U.S. Provisional Patent Application Ser. No. 61/237,512 dated Aug. 27, 2009.

BACKGROUND OF THE INVENTION

This invention is directed to golf clubs and particularly to the type of golf clubs commonly referred to as drivers or woods, that is, clubs with enlarged heads that drive or propel golf balls positioned on tees. Such clubs are frequently used in practice at driving ranges or other locations where a golfer practices his/her swing and driving techniques by placing multiple balls beside a practice tee and progressively hitting those balls. This procedure often, however, requires the golfer to bend over between swings to tee up another ball, and such action requires the golfer to regrip the golf club between swings. Obviously, regripping the golf club between swings is part of the actual golf game but in practice sessions, it is often desirable to maintain a consistent grip such that slight alternations of the grip may be made to determine the affect on the ball's trajectory, etc. Numerous machines and or devices have been developed to automatically or on call tee up balls to enable the golfer to maintain his/her grip on the golf club between swings. However, such devices require an electrical power source and thus are utilized mostly in a formal setting and are generally costly.

Thus, it would be desirable to provide golfers with a practice driver that will enable the golfer to pick up and place golf balls on a tee without releasing one's golf club grip and/or without the tiresome need for bending or stooping to set the ball upon the tee. A further desirable feature would be to provide such above features entirely within the golf dub head of the practice driver itself to eliminate the need for extra accessories or attachments and without requiring a power source other than that of the golfer.

These and other objects of the invention are provided by a golf club comprising a shaft in turn connected to a driving head, said head having front, side and bottom portions and including a generally planar ball contact face at the front portion thereof, said side portions including a curved upright wall extending rearwardly from said contact face and said bottom portion defined by a bottom wall such that the inside surfaces of said front, side and bottom portions define a hollow compartment within said driving head, said bottom wail including an opening of a diameter slightly larger than a golf ball forming the entrance to said compartment for such ball, said compartment including a ball supporting rest surface extending from the rear periphery of said opening towards the rear of said curved upright wall, said compartment further including a laterally extending bumper bar positioned rearwardly of said front wall inside surface and aligned above the forward periphery of said opening such that relative movement between said head and a golf ball positioned on a supporting surface and aligned with said opening causes the ball to contact said bumper bar as the golf ball moves into said compartment and be forced rearwardly into said ball supporting rest surface whereupon the ball and club can thence be moved as a unit and the ball then repositioned as upon a driving tee by tilting the head such that the ball rolls off the supporting rest surface and downwardly through said opening.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 5 is a view similar to FIG. 3 but showing the golf ball in its initial pickup position within the golf club head;

FIG. 5*a* is a sectional view along the line 5*a* -5*a* of FIG. 5;

FIG. 7 is a view similar to FIG. 5 showing the rearward motion of the golf ball and wherein the ball is supported on the ball supporting rest surface;

FIG. 7*a* is a sectional view along the line 7*a* -7*a* of FIG. 7 and shows the progressive ball movement to the rest position;

DESCRIPTION OF THE INVENTION

Figure 1:
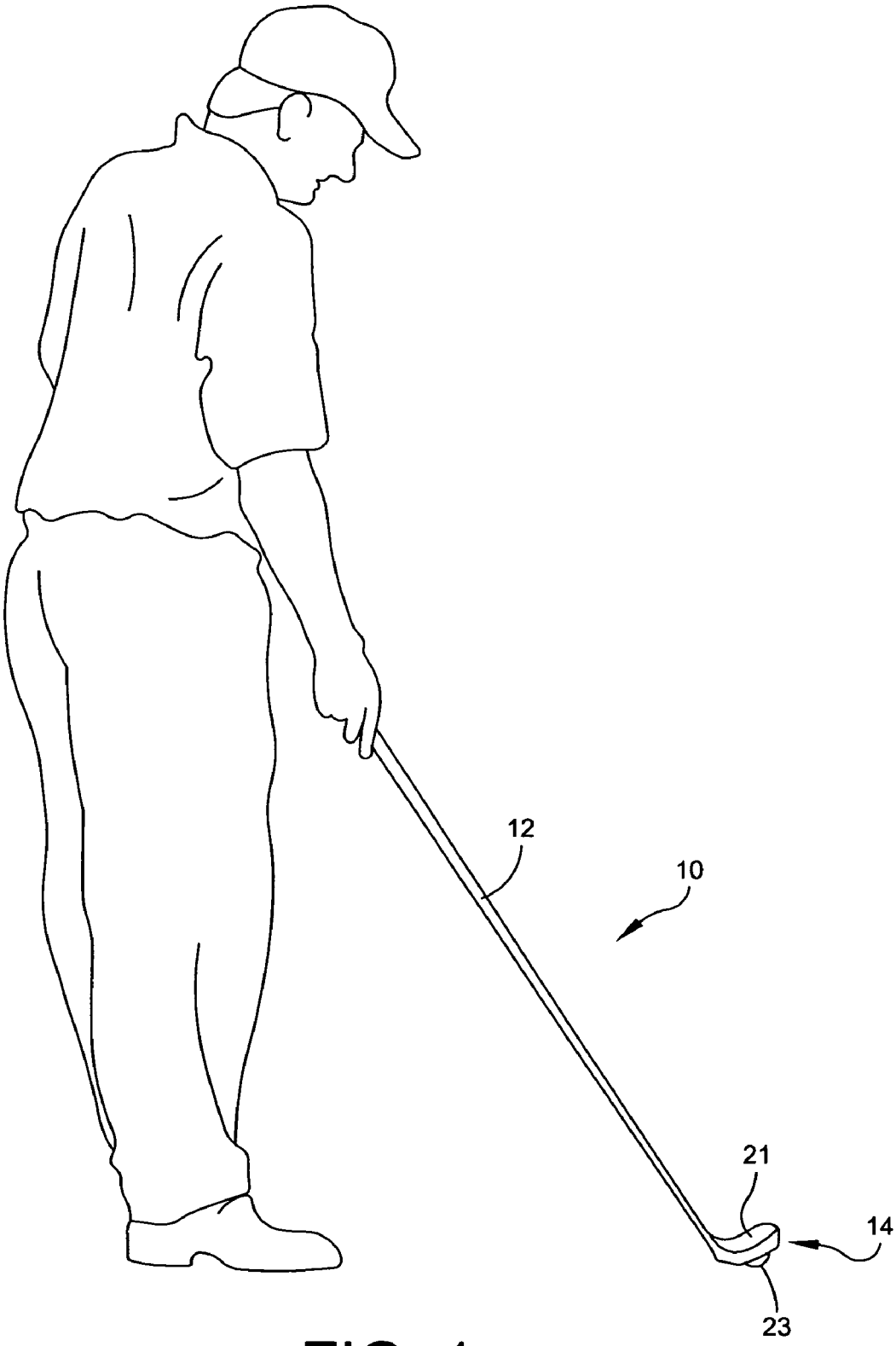
FIG. 1 is an elevational view of a golfer utilizing the novel golf club of the present invention.
Figure 2:
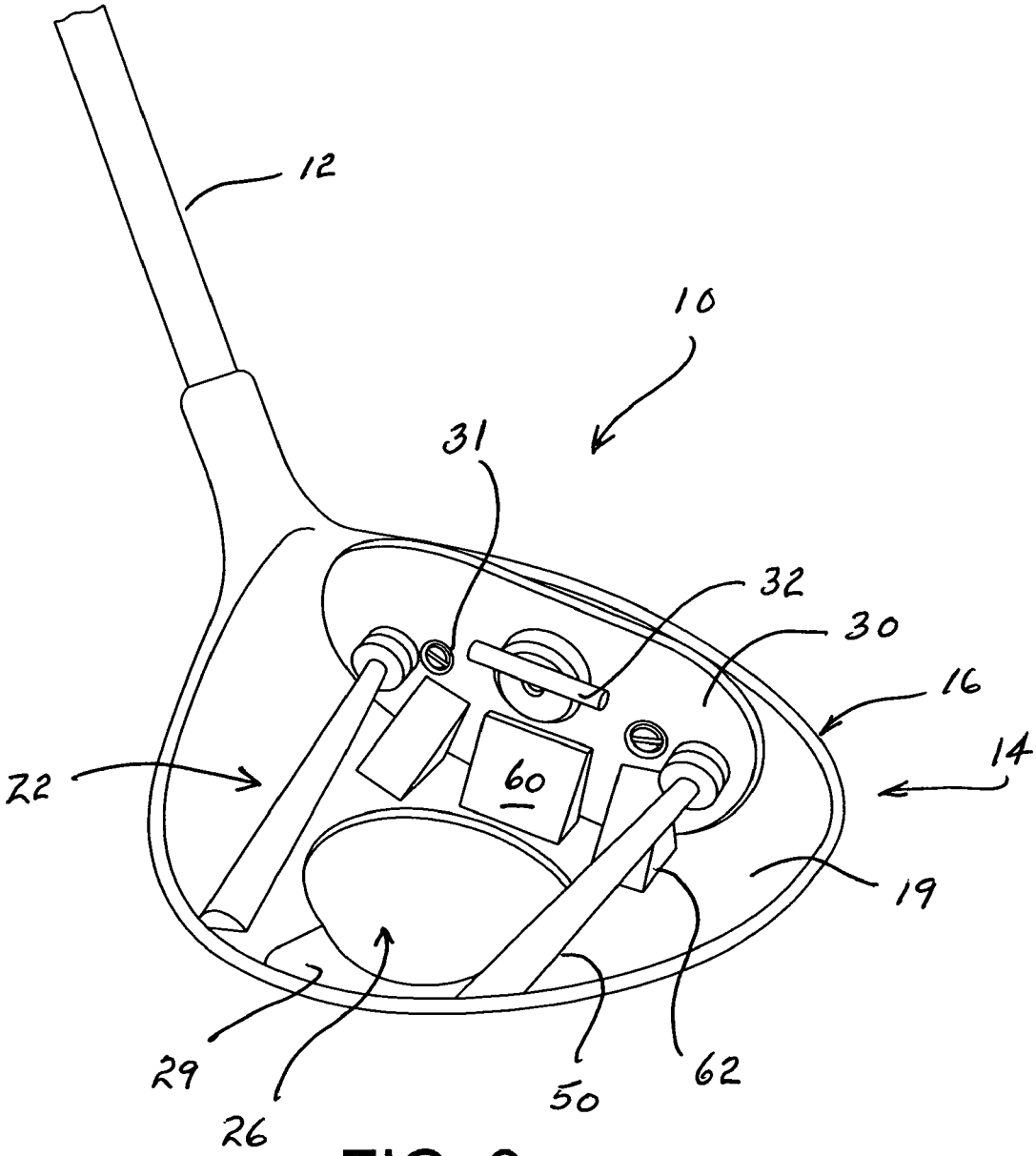
FIG. 2 is a top perspective view of a modified golf club head incorporating one form of the present invention.
Figure 3:
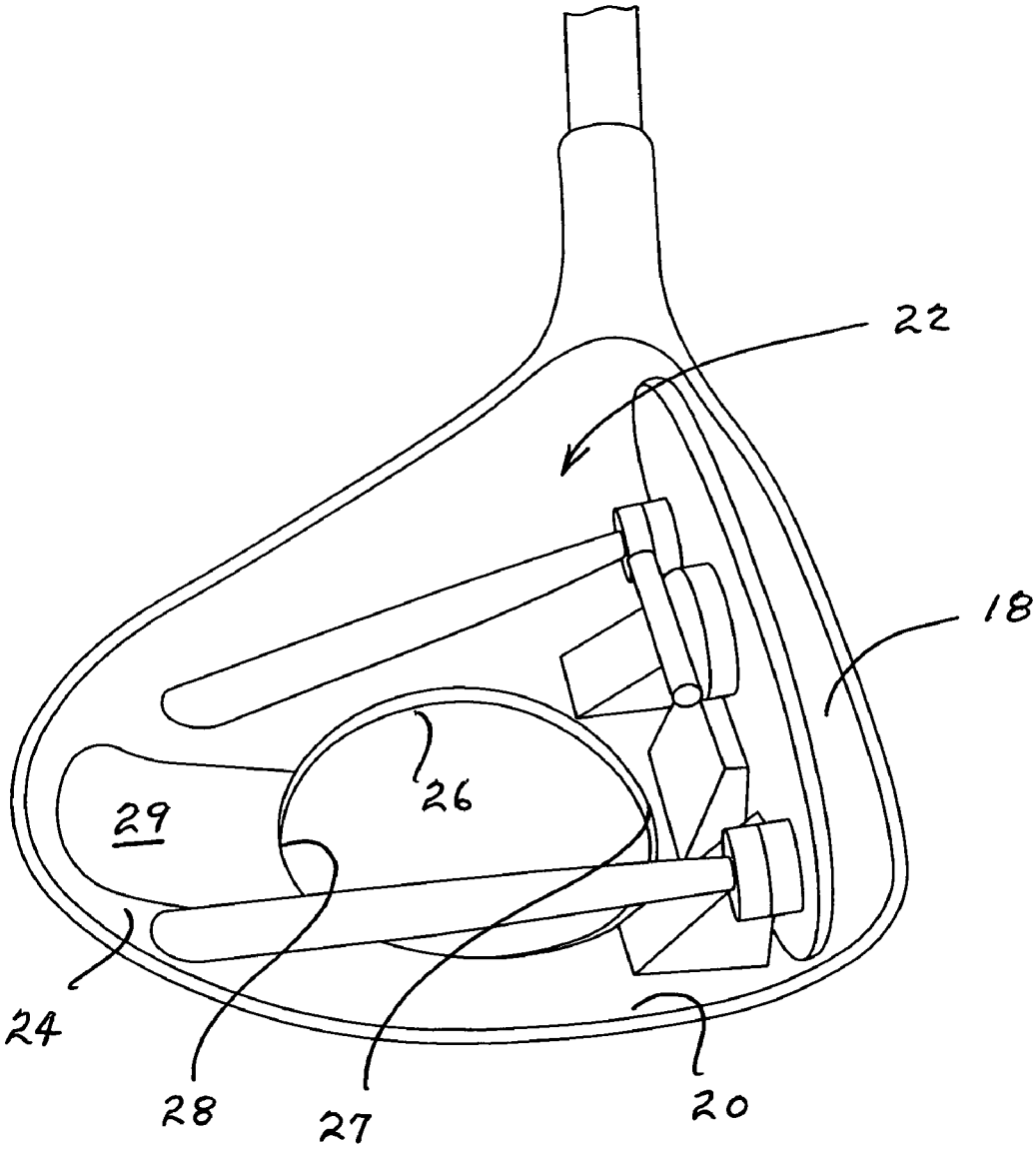
FIG. 3 is a top perspective view similar to FIG. 2 but rotated approximately 90° clockwise.

Turning to the drawings, FIGS. 1 and 2 show a golf club 10 incorporating the present invention. The golf club 10 includes a shaft 12 by which the golfer grasps and manipulates the club having an enlarged head 14. Generally, the golf club is a driver, that is, an enlarged head club used for driving or propelling a golf ball supported on golf ball tee although the invention could be incorporated in other "woods" or even utilized more broadly as a pick and place device for balls or other rolling objects other than golf balls; however, the invention is primarily directed to picking up a golf ball, placing the golf ball on a tee and then utilizing the golf club to strike such ball.

The golf club head 14 includes a front portion 16 from which a curved upright wall 18 rearwardly extends and a bottom portion including a bottom wall 20 which cooperate to define a hollow interior compartment 22. A top wall or cover 21 may be affixed to the upper edge of the wall 18 to give the golf club the appearance of an unmodified club head 14 as shown in FIG. 1. The bottom wall preferably assumes a slight upward slant at the rear 24 thereof as is natural with driving club heads and the bottom wall is additionally provided with a generally circular opening 26 of a diameter slightly larger than a conventional golf ball and front and rear edges 27, 28 respectively such that the interior area proximal to such opening and extending rearwardly therefrom forms a ball supporting rest surface 29 wherein the golf ball can be temporarily held after the golf ball passes upwardly through the opening 26 and then moved with the club to a tee for repositioning thereon without necessitating the golfer to release his/her club gripping position.

Figure 4:
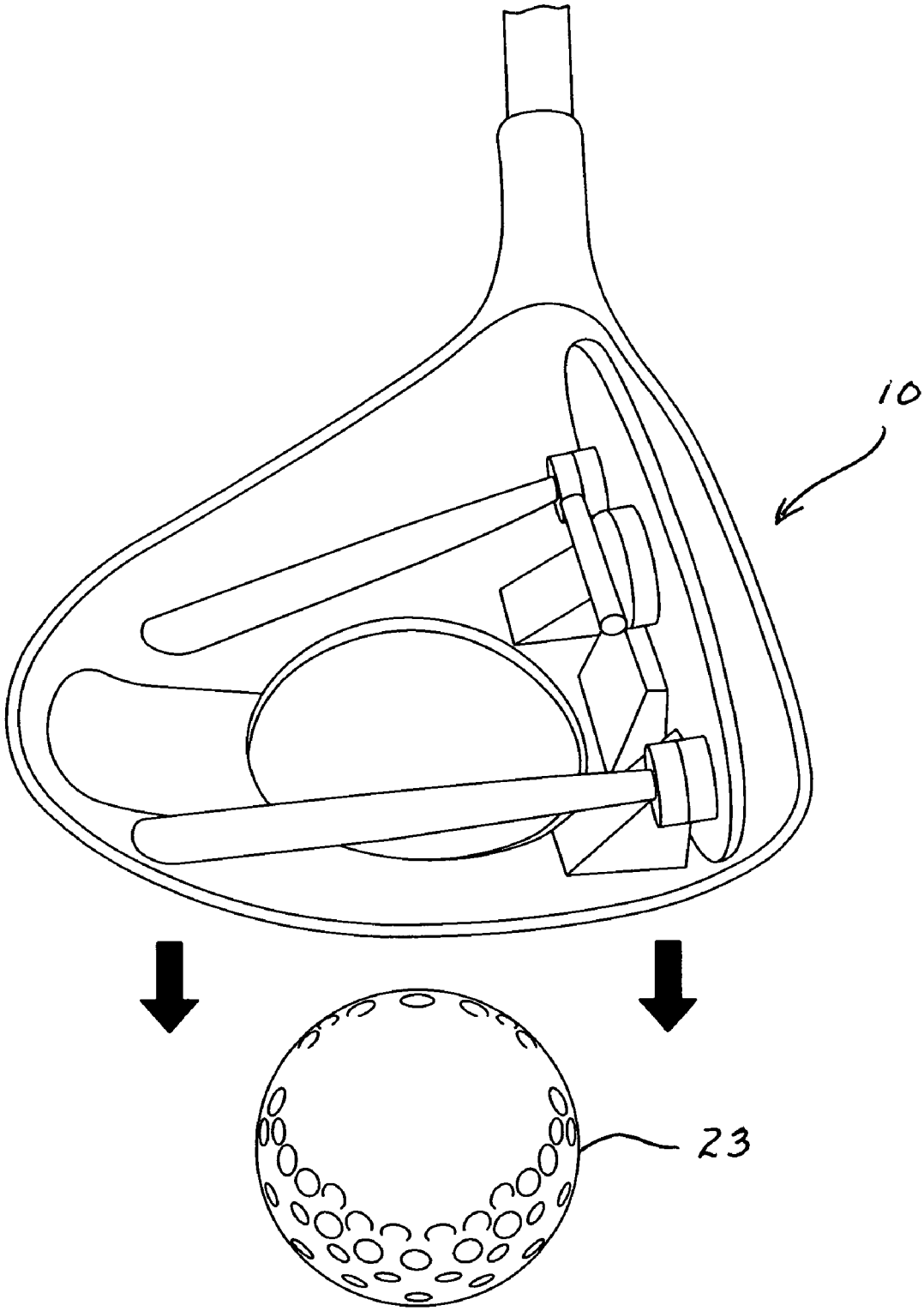
FIG. 4 is a view similar to FIG. 3 showing the golf club head positioned over a golf ball preliminary to initiating the ball pickup motion.
Figure 6:
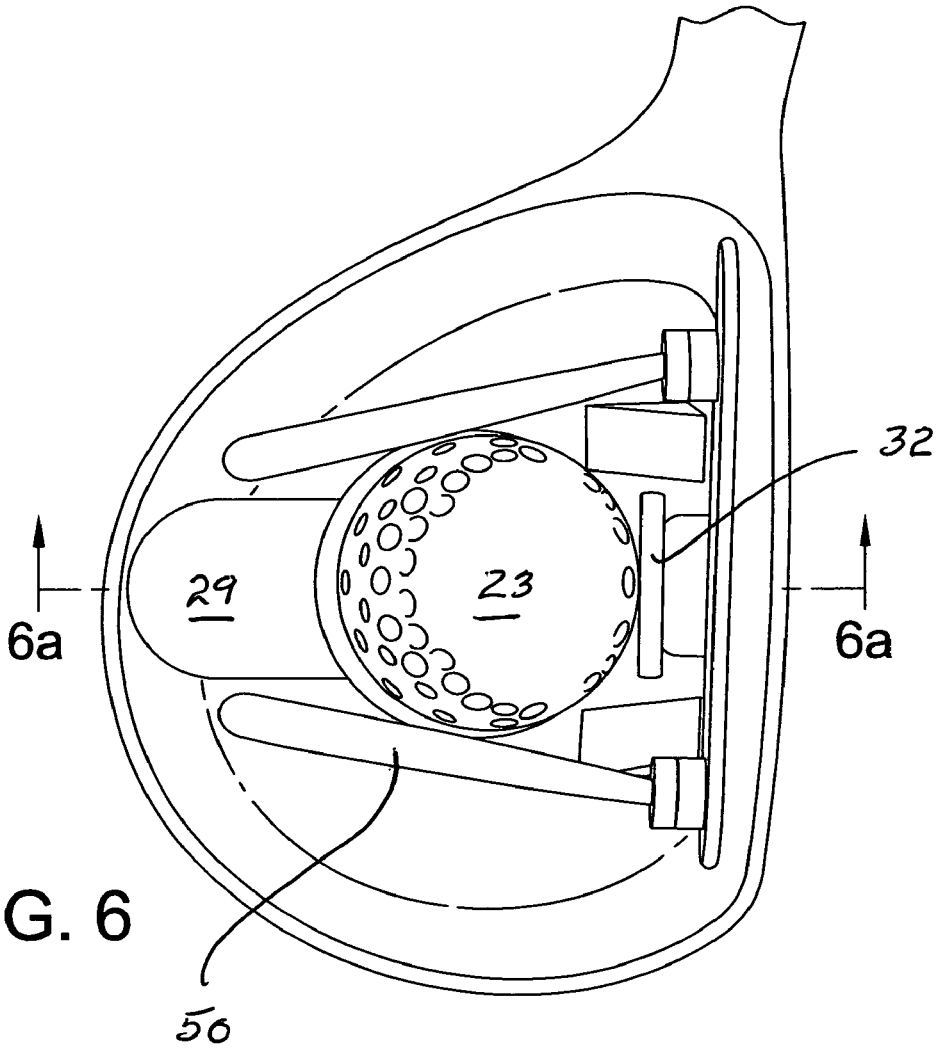
FIG. 6 is a view similar to FIG. 5 but rotated approximately 90° counter clockwise to better illustrate the golf ball's position in the initial pickup position.
Figure 6A:
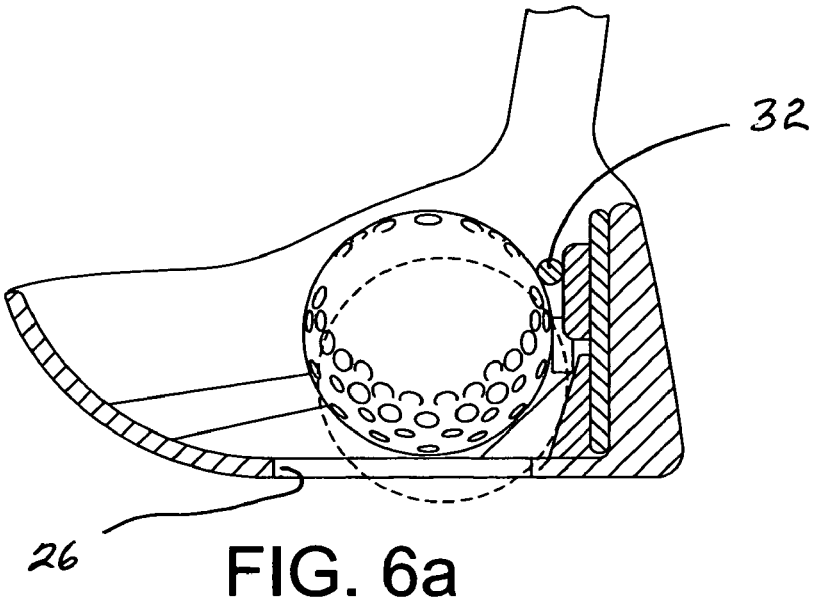
Figure 8:
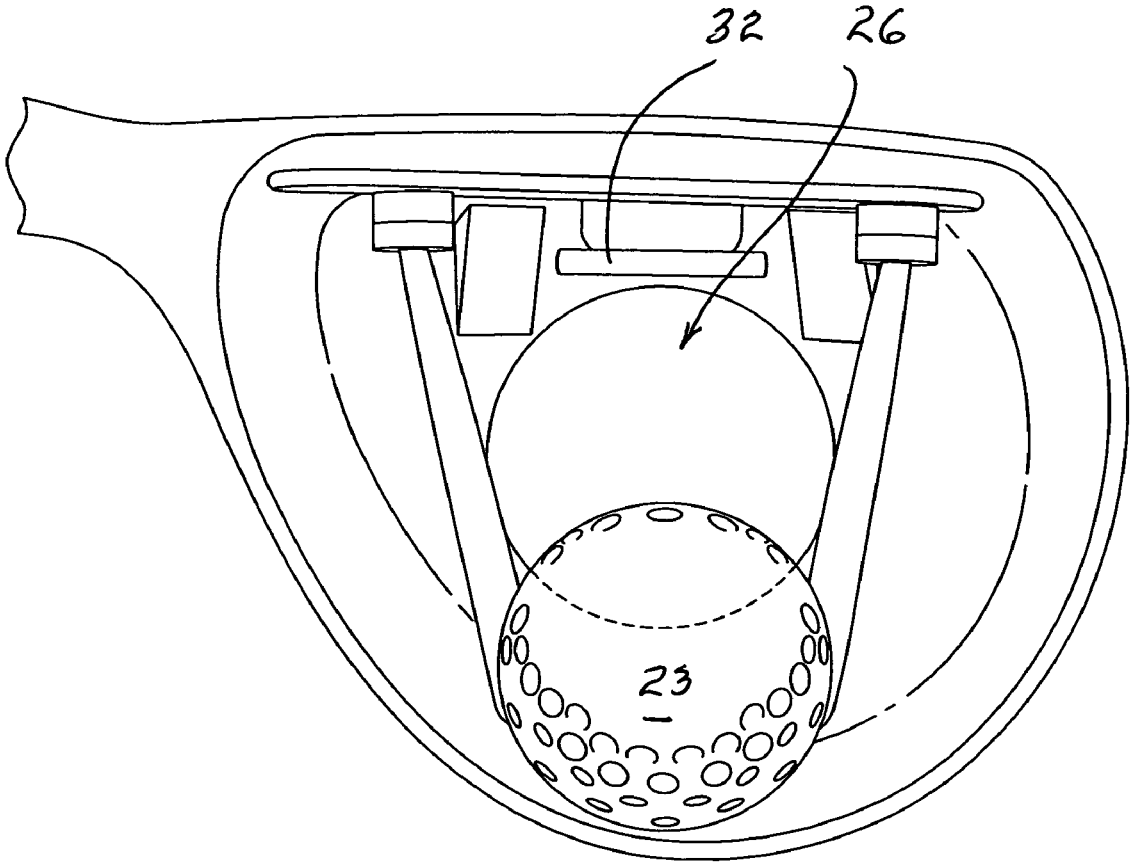
FIG. 8 is a top view similar to FIG. 7.
Figure 9:
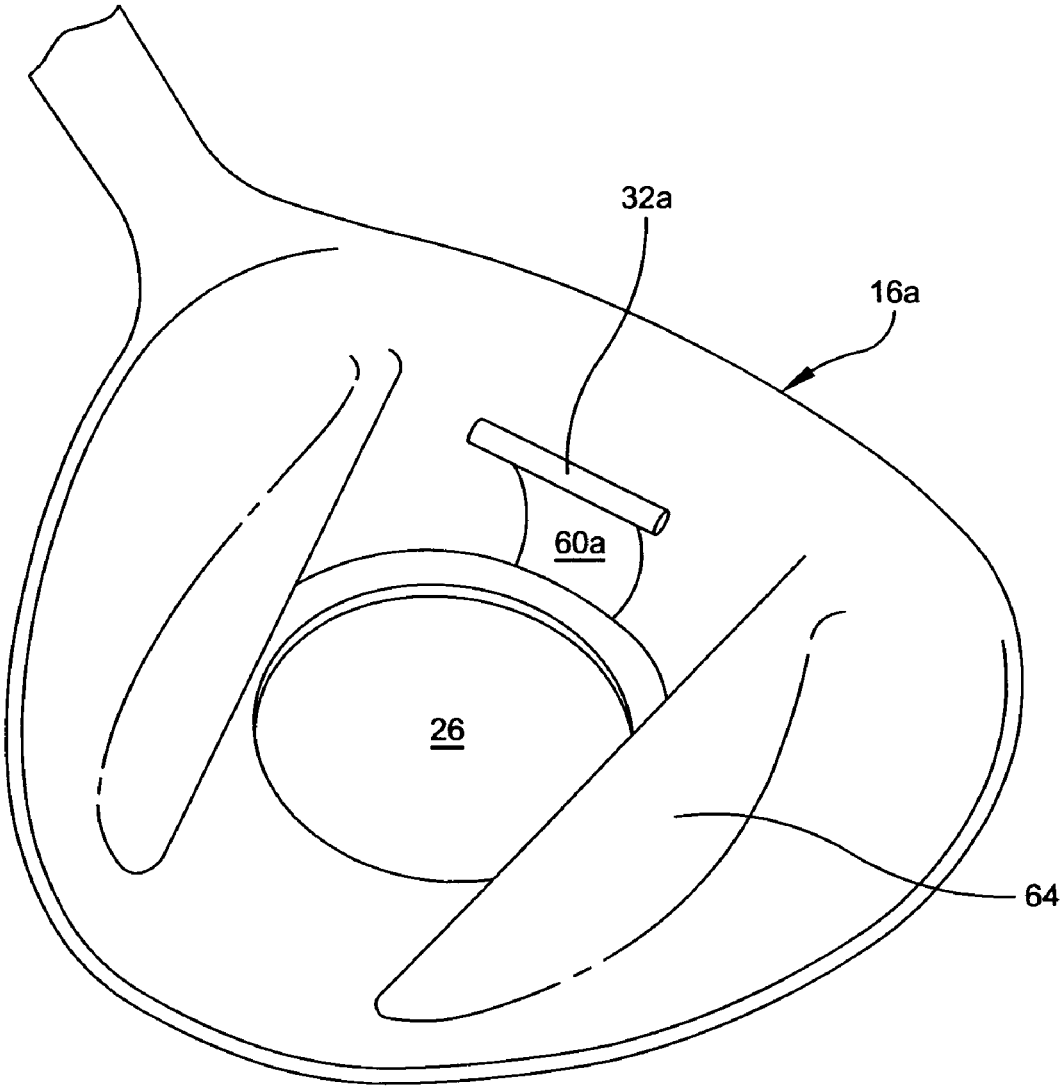
FIG. 9 is a top perspective view similar to FIG. 1 but showing an alternative form of the invention.

The front portion 16 of the club head includes a reinforcing plate 30 which may be welded or otherwise affixed, e.g., by screws 32, to the inner surface 19 of the wall 18 or may be machined to a thickness that accommodates the intended striking of a golf ball with the golf club in practice or in actual play (see FIG. 9). The plate 30 further includes a bumper bar 32 that is mounted above and generally in line with the vertical extent of the forward most edge (front edge 27). The bumper bar 32 is preferably circular and laterally extends across a portion of the compartment 22 and at a height above the inner surface of the bottom wall 20 somewhat less than that of the diameter of a conventional golf ball 23. Such height placement of the bar 32 assures contact with the top forward portion of the ball as the golf ball moves upwardly into the compartment 20 via the relative downward movement of the golf club head 14 as illustrated in the transition between FIGS. 4, 5 and 6 of the drawings. This aforementioned contact with the ball drives the ball rearwardly within the compartment. Guide means 50 in the form of a pair of laterally separated rearwardly inwardly extending rails channel the ball rearwardly to the rest surface 29. The rails preferably are of rod-like configuration and may also be tapered from a narrow diameter proximal to the bumper 32 to a thicker diameter proximal the rest surface 29. Maintaining the ball 23 on the rest surface 29 can be further facilitated by tilting the club head slightly such that the rear 24 of the bottom wall is lowered which further, in effect, pockets the ball within the slight upward slant thereof. With the ball positioned upon the rest surface 29, the club may be moved to a position above a tee whereupon the golf club head may be slightly tilted to lift the rear wall thereof so as to roll the ball forwardly off the rest such that the ball drops through the opening onto the tee. The above action may be accomplished without relinquishing the club grip. Thereafter, the golfer may strike the teed-up ball and then repeat the above described pick, place and swing regimen without releasing his/her golf club grip.

In order to better direct the golf ball as the ball enters the compartment in a slight upward forward direction into contact with the bumper, it is preferred to incorporate a central upwardly forwardly extending ramp 60 as well as a pair of side ramps 62. Such ramps may be connected to the plate 30 or as in the case of the rails and bumper incorporated into the compartment by integrally molding, casting or machining. Additionally as shown in FIG. 9, it may be desirable to minimize the open areas of the compartment by filling in or blocking any open compartment portions that are unnecessary for the functioning of the device, e.g., forming solid areas 64 extending rearwardly from the front portion 16*a* of this golf club form shaped either by a formative machining or casting process and wherein the bumper 32*a* and the ramps 60*a*, 62*a* when included would be integral with the club head body, e.g., the solid areas could be metal, etc.

The golf club may be one piece with no particular moving parts. The bumper directs the ball up and back. With a push-down motion, the ball is directed up and back onto the inclining and declining rails (the back of the club). Once the golf ball is contained within the golf club, the golf ball is positioned above the tee and then the golfer turns his/her wrist to initiate the golf ball rolling back down the rails to the bumper and down onto the waiting golf tee.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A golf club comprising a shaft in turn connected to a driving head, said head having front, side and bottom portions and including a generally planar ball contact face at the front portion thereof, said side portions including a curved upright wall extending rearwardly from said contact face and said bottom portion defined by a bottom wall such that the inside surfaces of said front, side and bottom portions define a hollow compartment within said driving head, said bottom wall including an opening of a diameter slightly larger than a golf ball forming the entrance to said compartment for such ball, said compartment including a ball supporting rest surface on which the ball is adapted to rest on top thereof, said ball supporting rest surface separate from and position to the rear of said opening and extending from the rear periphery of said opening towards the rear of said curved upright wall, said compartment further including a laterally extending bumper bar positioned rearwardly of said front wall inside surface and aligned above the forward periphery of said opening such that relative movement between said head and a golf ball positioned on a supporting surface and aligned with said opening causes the ball to contact said bumper bar as the golf ball moves into said compartment and be forced rearwardly into said ball supporting rest surface whereupon the ball and club can thence be moved as a unit and the ball then repositioned as upon a driving tee by tilting the head such that the ball rolls off the supporting rest surface and downwardly through said opening, wherein said head further includes guide means for guiding the ball rearwardly from said opening to said rest surface and thereafter forwardly from said rest surface to said opening, said guide means comprising a pair of laterally spaced ball contacting members rearwardly inwardly extending from said front wall inside surface and said guide means ball contacting members are a pair of rails extending between said front wall inside surface and the rear of said curved upright wall.

2. The golf club of claim 1, wherein said rails are cylindrical roller rails.

3. The golf club of claim 1, wherein said guide means ball contacting members are integral with said side portions of said head.

4. The golf club of claim 3, wherein said compartment includes a ball guide ramp upwardly forwardly extending from said bottom wall to said front wall at a height beneath said bumper bar.

5. The golf club of claim 4, wherein said ramp is a pair of laterally spaced ramp portions.

* * * * *